US006591584B1

(12) United States Patent
Saito

(10) Patent No.: US 6,591,584 B1
(45) Date of Patent: Jul. 15, 2003

(54) METHOD FOR PRODUCING FLUID PACKAGE OF FLUIDIZED SUBSTANCE

(75) Inventor: Tadashi Saito, Tochigi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/869,422

(22) PCT Filed: Dec. 27, 1999

(86) PCT No.: PCT/JP99/07357

§ 371 (c)(1),
(2), (4) Date: Jul. 19, 2001

(87) PCT Pub. No.: WO00/38989

PCT Pub. Date: Jul. 6, 2000

(30) Foreign Application Priority Data

Dec. 28, 1998 (JP) ..... 10-372068

(51) Int. Cl.[7] ..... B65B 9/00

(52) U.S. Cl. ..... 53/450; 53/454; 53/560; 53/555

(58) Field of Search ..... 53/450, 454, 474, 53/553, 560, 555, 239

(56) References Cited

U.S. PATENT DOCUMENTS 5,081,819 A * 1/1992 Cloud ..... 53/453
5,459,980 A * 10/1995 Kenney et al. ..... 53/453

FOREIGN PATENT DOCUMENTS

| | | | |
|---|---|---|---|
| JP | 5829901 | | 2/1983 |
| JP | 6-80108 | * | 3/1994 |
| JP | 6-191505 | * | 7/1994 |
| JP | A761414 | | 3/1995 |
| JP | 07-124193 | | 5/1995 |

OTHER PUBLICATIONS

English translation of JP 58–29901, Feb. 26, 1983.*

* cited by examiner

*Primary Examiner*—Ted Kavanaugh
(74) *Attorney, Agent, or Firm*—Birch, Stewart, Kolasch & Birch, LLP

(57) ABSTRACT

A method for producing a package of a fluidized substance is disclosed. The method includes a supplying step in which a prescribed amount of a fluidized substance (103) is supplied onto a first sheet (a first sheet 101' of continuous length) by use of a metering-applicator (2) for the fluidized substance comprising a metering through-hole (21) having an outer opening and an inner opening. The supplying step comprises positioning the first sheet so as to be brought into contact with the outer opening of the metering through-hole (21), and then supplying the fluidized substance (103) from the inner opening of the metering through-hole (21) via the metering through-hole (21) onto the first sheet while the first sheet is conveyed.

8 Claims, 4 Drawing Sheets

METHOD FOR PRODUCING FLUID PACKAGE OF FLUIDIZED SUBSTANCE

This application is the national phase under 35 U.S.C. § 371 of PCT International Application No. PCT/JP99/07357 which has an international filing date of Dec. 27, 1999, which designated the United States of America.

TECHNICAL FIELD

The present invention relates to a method for producing a package of a fluidized substance with, good productivity and an apparatus used therefor. The package of the fluidized substance produced by the process of the present invention are suitable for use as, for example, disposable body warmers and detergent articles of sheet form.

BACKGROUND ART

Methods of producing a package of a fluidized substance include the method disclosed in for example Japanese Patent Laid-Open No. 7-124193, in which powder packages are produced at a high speed by making use of a magnet.

According to such a conventional method of fluidized substance package production, however, since powder is transferred between a plurality of rollers by making use of magnetic force, powder packages having a distinct and arbitrary shape cannot be obtained. Further, is the method is not applicable where a substance to be packaged is a powder containing no magnetic particles or a viscous substance such as paste or gel.

DISCLOSURE OF THE INVENTION

An object of the present invention is to provide a method for producing a package of a fluidized substance with good productivity.

The present invention accomplishes the above object by providing a method for producing a package of a fluidized substance comprising supplying a fluidized substance on a first sheet, covering the supplied fluidized substance with a second sheet, and sealing the two sheets together in a prescribed shape to make a package of a fluidized substance comprising said first sheet, said second sheet and said fluidized substance held therebetween, said method includes a supplying step in which a prescribed amount of said fluidized substance is supplied onto said first sheet by use of a metering-applicator for said fluidized substance comprising a metering through-hole having an outer opening and an inner opening, said supplying step comprising positioning said first sheet so as to be brought into contact with said outer opening of said metering through-hole, and then supplying said fluidized substance from said inner opening of said metering through-hole via said metering through-hole onto said first sheet while said first sheet is conveyed.

The present invention also provides an apparatus which can be preferably used to carry out the above-described method, which comprises:

- a metering-applicator for a fluidized substance which comprises a cylindrical body and a plurality of metering through-holes piercing said cylindrical body in the radial direction of said cylindrical body;
- a supplying unit for supplying the fluidized substance into said metering through-hole which comprises a supply pipe for the fluidized substance and a leveling unit which joins the lower part of said supply pipe and has an opening for supplying the fluidized substance, said leveling unit being disposed inside said metering-applicator in such a manner that said leveling unit is brought into contact with the inner wall of said metering-applicator; and
- a means for conveying said first sheet and pressing said first sheet toward said leveling unit.

The term "fluidized substance" as used herein denotes a substance the fluidity of which is such that the substance substantially keeps its outer shape it has possessed when supplied on a first sheet until it is covered with a second sheet, and the first and the second sheets are sealed together. Various viscous substances having such fluidity are included under this term, for example, powder and granular materials, gel, paste, and dough.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

BEST MODE FOR CARRYING OUT THE INVENTION

A preferred embodiment for carrying out the method for producing a package of a fluidized substance according to the invention will be described.

Figure 1:
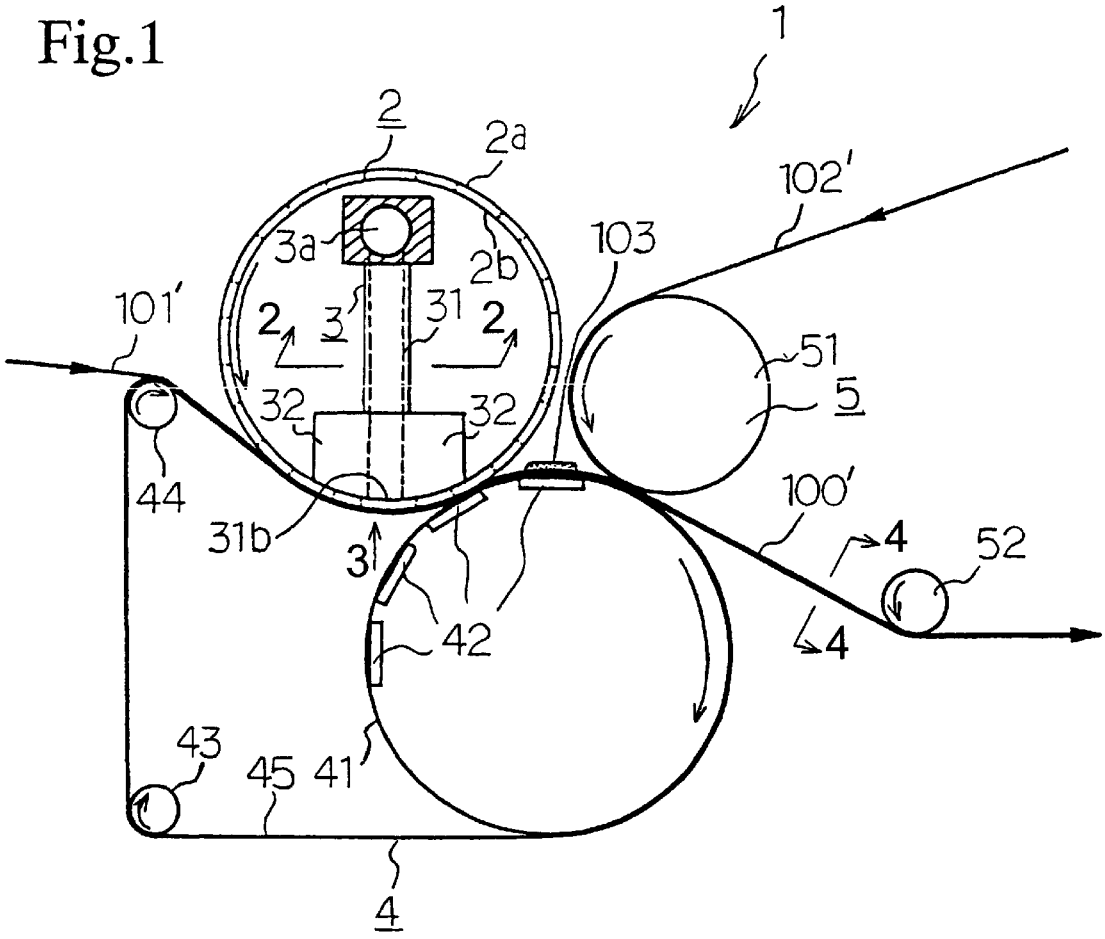
FIG. 1 is a schematic view of an apparatus which is preferably used in the method for producing a package of a fluidized substance according to the present invention.
Figure 2:
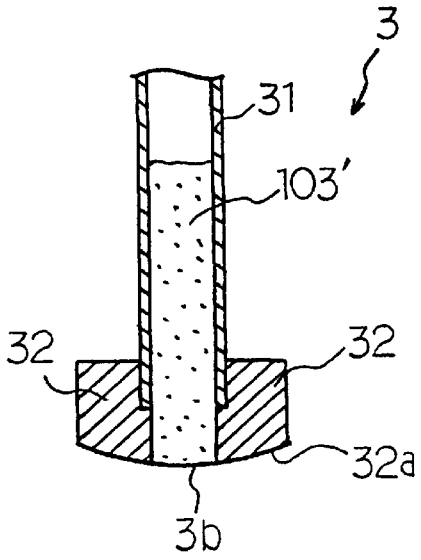
FIG. 2 is a cross-section of FIG. 1 taken along line 2—2.
Figure 3:
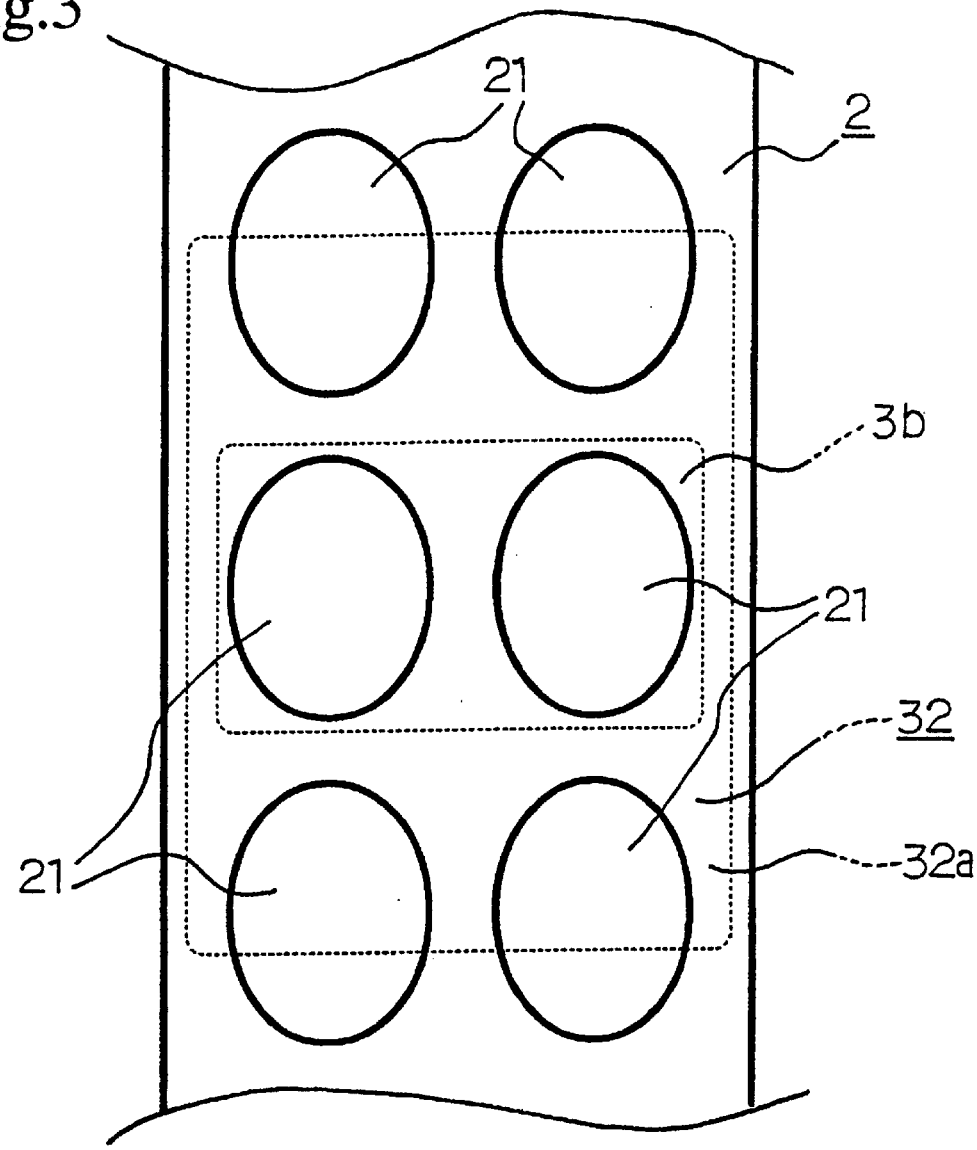
FIG. 3 is a view of FIG. 1 from the direction pointed by arrow 3.

An apparatus which can preferably be used in the method of the invention is described first. As shown in FIGS. 1 through 3, the producing apparatus 1 for the fluidized substance package according to this embodiment comprises a metering-applicator 2 for a fluidized substance which comprises a cylindrical body and a plurality of metering through-holes 21 arranged along the circumferential direction of the cylindrical body and piercing the cylindrical body in the radial direction thereof; a supplying unit 3 for supplying a fluidized substance into the metering through-hole 21 which comprises a supply pipe 31 for a fluidized substance and a leveling unit 32 which joins the lower part of the supply pipe 31 and has an opening 3*b* for supplying a fluidized substance, the leveling unit 32 being disposed inside the metering-applicator 2 in such a manner that the leveling unit 32 is brought into contact with the inner wall of the metering-applicator 2, i.e., the inner opening of the metering through-hole 21; and a means 4 for conveying the first sheet and pressing the first sheet toward the leveling unit 32.

As shown in FIGS. 1 and 3, the metering-applicator 2 has a cylindrical body (drum) with a plurality of rows of elliptic metering through-holes 21 piercing through its wall from one side (outer side) 2*a* to the other side (inner side) 2*b*. The rows of the metering through-holes 21 are arranged in the width direction of the drum. The side 2*a* of the metering-applicator 2 is equivalent to the outer opening of the metering through-holes 21, and the other side 2*b* corresponds to the inner opening. The metering-applicator 2 can be driven by a driving system conventionally used for rotating drums. While in FIG. 3 the metering through-holes 21 are made in two rows, they can be arranged in a single row or three or more rows. Not all the metering through-holes 21 need to have the same shape, and they can have various shapes or intervals. The metering-applicator 2 rotates in the same direction as the moving direction of a first sheet 101' of continuous length hereinafter described.

The metering through-holes 21 function as measures for taking up a prescribed amount of a fluidized substance supplied from the supplying unit 3. In detail, each metering through-hole 21 has a prescribed depth, and a first sheet 101' of continuous length is conveyed while keeping in contact with the outer opening of the metering through-hole 21, i.e., the outer side 2*a* of the metering-applicator 2, preferably until the leveling unit 32 completely shuts the inner opening of the metering through-hole 21, thereby to form a volumetric metering space for a fluidized substance having prescribed volume and shape.

As shown in FIGS. 1 to 3, the supply pipe 31 of the supplying unit 3 has a rectangular cross-section, taken in the horizontal direction (in the direction perpendicular to the axis), of a size enough to contain one pair out of two rows of the metering through-holes 21. The pipe 31 has, at one of its ends in the center side of the metering-applicator 2, an opening 3*a* for supplying a fluidized substance which is connected to a supplying tank of a fluidized substance (not shown). The other end, which is in contact with the metering-applicator 2, is connected to the leveling unit 32. The leveling unit 32 is provided to surround the circumference of the supply pipe 31. The lower surface 32*a* of the leveling unit and the opening 3*b* are brought into contact with the inner wall of the metering-applicator 2. The lower surface 32*a* is curved in conformity to the inner wall of the metering-applicator 2.

The first sheet conveying means 4 comprises a hollow drive roller 41 having inside a good number of magnets 42, two guide roller 43 and 44, and a seamless belt 45. There are as many magnets 42 as the metering through-holes 21 arranged inside the drive roller 41 to mate the individual metering through-holes 21 of the metering-applicator 2. Although FIG. 1 shows only some of the magnets 42 for the sake of simplicity, the magnets 42 are disposed over the whole inner circumference of the drive roller 41. As the drive roller 41 rotates in the direction indicated by the arrow in FIG. 1, the seamless belt 45 moves in the same direction, and the first sheet 101' of continuous length is carried by the moving seamless belt 45. The first sheet 101' of continuous length is thus conveyed while keeping in contact with the outer opening of the metering through-holes 21 of the metering-applicator 2. The seamless belt 45 also functions as a means for pressing the first sheet 101' of continuous length toward the leveling unit 32.

The production apparatus 1 according to the present embodiment has a second sheet conveying means 5 for conveying a second sheet 102' of continuous length hereinafter described. The second sheet conveying means 5 comprises a heat-sealing roller 51 and a guide roller 52. The heat-sealing roller 51 is disposed so as to come into contact with the drive roller 41 of the first sheet conveying means 4 and rotates in the opposite direction of the drive roller 41. The second sheet 102' of continuous length is conveyed by the rotating heat-sealing roller 51. The heat-sealing roller 51 is capable of being heated so that the first sheet 101' of continuous length and the second sheet 102' of continuous length held between the heat-sealing roller 51 and the drive roller 41 are sealed to make a prescribed shape under heat and pressure.

Figure 4:
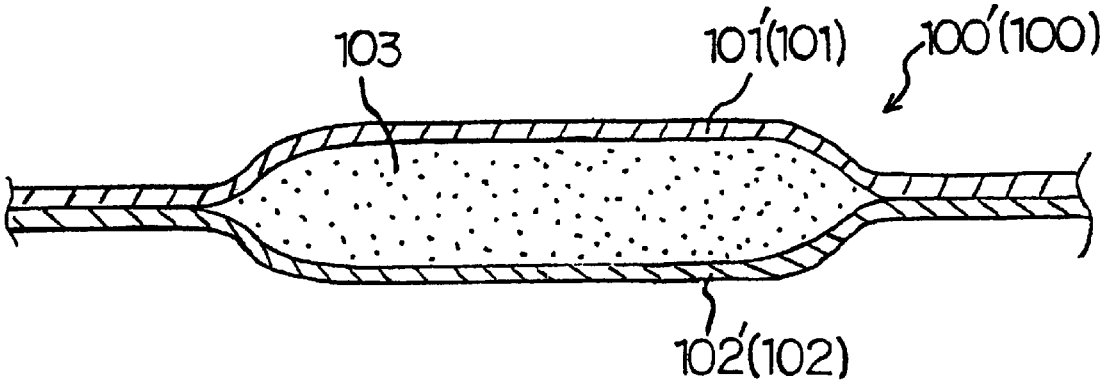
FIG. 4 is a cross-section of FIG. 1 taken along line 4—4.

As shown in FIG. 4, fluidized substance packages 100 obtained in the present embodiment are each composed of an air-permeable sheet 101 made of the first sheet, a moisture proof sheet 102 made of the second sheet, and a fluidized substance 103 which is a heat-generating powder containing iron powder. The sheeting conveyed by the first sheet conveying means 4 is the first sheet 101' of continuous length, and that conveyed by the second sheet conveying means 5 is the second sheet 102' of continuous length. The air-permeable sheet, the moisture proof sheet, and the powder can be of those employed in conventional disposable body warmers, etc.

The method for producing a package of a fluidized substance according to the present embodiment is implemented by the step of supplying a prescribed amount of the fluidized substance 103 onto the first sheet (i.e., the first sheet 101' of continuous length) by use of the above-described production apparatus 1, wherein the step is carried out by positioning the first sheet on one side (outer side) 2*a* of the metering through-hole 21 of the metering-applicator 2 and intermittently dispensing the fluidized substance 103' from the other side (inner side) 2*b* of the metering through-hole 21 via the through-hole 21 onto the first sheet while being conveyed.

In carrying out the fluidized substance supplying step, the drive roller 41 of the first sheet conveying means 4 is turned around in the direction indicated by the arrow in FIG. 1. Thus, the first sheet 101' of continuous length is carried in the direction indicated by the arrow in FIG. 1 and, at the same time, pressed toward the supply pipe 31 by the seamless belt 45, whereby the outer opening of the metering through-hole 21 is shut up with the first sheet 101' of continuous length. As a result, there is formed a volumetric metering space for a fluidized substance. Separately, a fluidized substance 103 has previously been charged into the supply pipe 31, and the metering-applicator 2 is rotated in the direction indicated by the arrow in FIG. 1. The amount of the fluidized substance 103 to be charged is such that the fluidized substance 103 in the pipe 31 has a sufficient weight for falling by gravity into the volumetric metering space to closely fill it. Where the fluidized substance contains iron powder and the like, a magnet can be used to attract the fluidized substance into the metering through-holes 21 and fill it with the fluidized substance thereby to ensure filling without relying on gravity. Where the fluidized substance is a highly viscous substance, it can be injected into the supply pipe 31 under pressure thereby to ensure filling it without relying on gravity. When the metering through-hole 21 of the rotating metering-application 2 comes right under the opening 3*b*, the fluidized substance 103 closely fills the volumetric metering space by gravity. Meanwhile, since the first sheet 101' of continuous length is pressed toward the leveling unit 32 by the seamless belt 45, the volumetric metering space is filled with a fixed amount (a fixed volume) of the fluidized substance, and the filling operation proceeds extremely smoothly. As the metering-applicator 2 further rotates, the inner opening of the metering through-hole 21 is leveled by the leveling unit 32. As a result, the volumetric metering space is filled with the fluidized substance having approximately the same apparent volumes as the capacity of the volumetric metering space.

As the metering-applicator 2 further turns around, the first sheet 101' of continuous length that has been kept in contact with one side (outer side) 2*a* of the metering-applicator 2 while being conveyed begins to separate from the side 2*a*, whereupon the fluidized substance 103 packed into the volumetric metering space remains on the first sheet 101' of continuous length. That is, a fixed amount (volume) of the fluidized substance 103 is supplied onto the first sheet 101' of continuous length. Because the fluidized substance 103 has shape retention to some extent, the overall shape of the fluidized substance 103 remaining on the first sheet 101' of continuous length is practically the same as what would be when the volumetric metering space is developed onto a flat plane.

As shown in FIG. 1, there is the magnet 42 disposed under the first sheet 101' of continuous length on the side opposite to the side where the fluidized substance 103 has been supplied. Therefore the fluidized substance 103 left on the first sheet 101' of continuous length retains its shape satisfactorily. In detail, the magnets 42 are arrayed in the drive roller 41 at positions corresponding to the individual portions of the fluidized substance 103, that is, corresponding to the individual metering through-holes 21. Additionally, the fluidized substance 103 contains iron powder. It follows that each portion of the fluidized substance 103 can be carried while retaining its shape satisfactorily by the action of the magnet 42. Accordingly, the production method of this embodiment is excellent in shape retention of the fluidized substance. Further, the time for the fluidized substance left on the first sheet 101' of continuous length to be covered with the second sheet 102' of continuous length is short enough so that the fluidized substance 103 hardly collapses during that time, which allows the fluidized substance 103 to be packed into an arbitrary package shape.

The first sheet 101' of continuous length on which portions of the fluidized substance 103 having a prescribed shape have been put is then sent toward the heat-sealing roller 51. Separately, the second sheet 102' of continuous length is supplied by the heat-sealing roller 51. The heat-sealing roller 51 has been heated to a prescribed temperature. The continuous sheets 101' and 102' join at the nip of the heat-sealing roller 51 and the drive roller 41 whereby the fluidized substance 103 on the first sheet 101' of continuous length is covered with the second sheet 102' of continuous length. Simultaneously the first and second sheets 101' and 102' of continuous length are heat-sealed at the periphery around the fluidized substance 103 by the nip pressure between the heat-sealing roller 51 and the drive roller 41 to make links of packages 100'. The links of packages are then cut across the width between every adjacent two. The thus separated packages are individually sealed in an air-impermeable film, etc. to provide final products (not shown).

According to the method and the apparatus for producing a package of a fluidized substance of the present invention, because the package can be manufactured by means of three rollers (drums) adjacent to one another, the production of the package attains satisfactory productivity. Since a fluidized substance can be packaged into an arbitrary shape even with no magnets, any fluidized substance can be dealt with in producing the package of desired shape with good productivity. Where the fluidized substance contains iron powder, it is particularly effective to use magnets.

Figure 5:
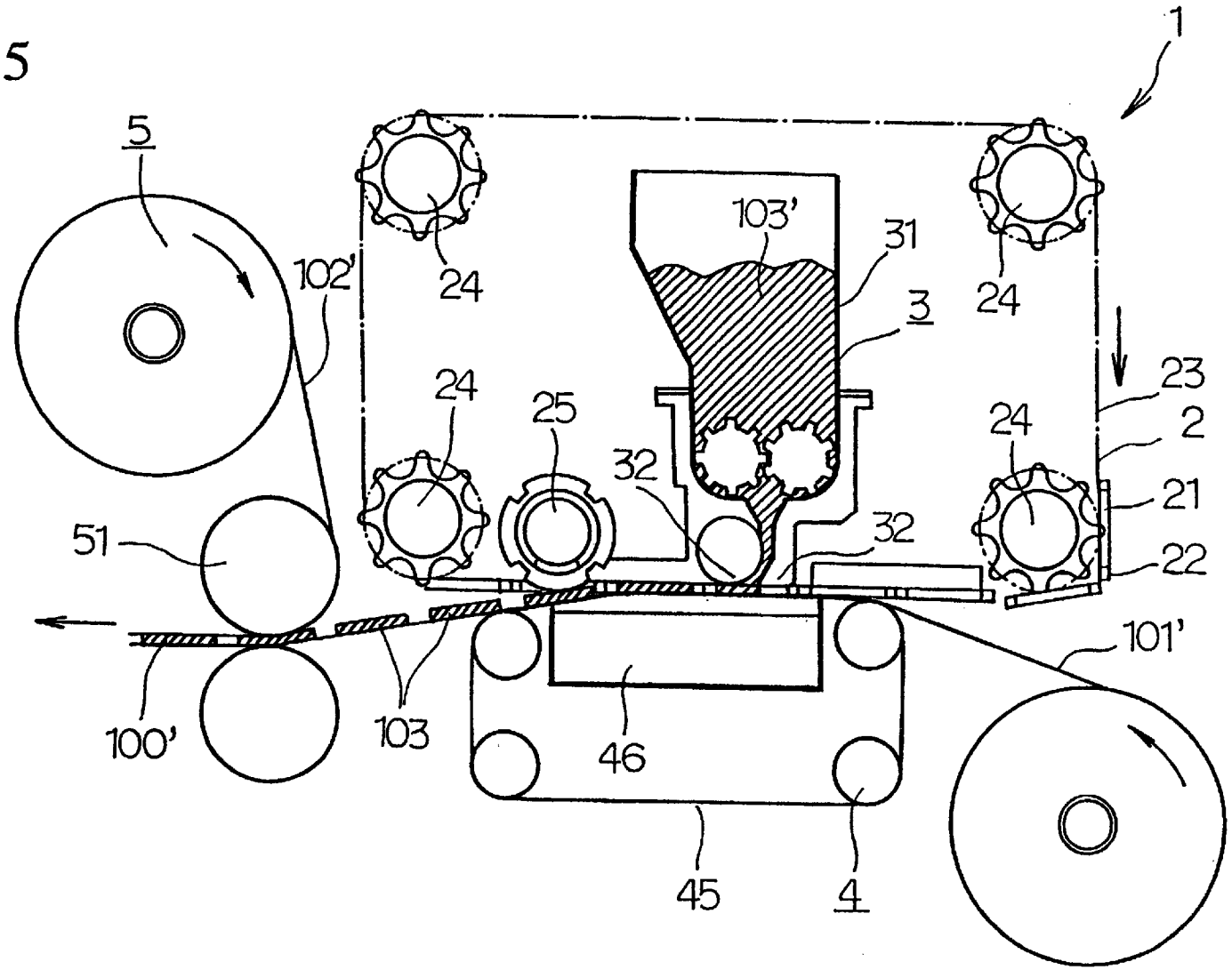
FIG. 5 is a schematic view of another embodiment of the apparatus which can be used in the method for producing a package of a fluidized substance according to the present invention.

The method for producing a package of a fluidized-substance according to the present invention can also be carried out by use of an apparatus of the type shown in FIG. 5. This embodiment will be illustrated only with respect to the particulars different from the first embodiment. Otherwise the description given to the first embodiment applies appropriately.

In the production apparatus 1 shown in FIG. 5, a metering-applicator 2 for a fluidized substance comprises a chain conveyer 23 having a plurality of flat and sheet-like frames 22 each having a metering through-hole 21 with a prescribed depth. The chain conveyer 23 turns in the direction indicated by the arrow in FIG. 5. Numeral reference 24 in FIG. 5 indicates a conveyer driving roller.

A first sheet conveying means 4 has a suction conveyer 45 and a suction box 46 where a fluidized substance 103' is attracted and fixed on a first sheet 101' of continuous length. The first sheet 101' of continuous length is conveyed by the suction conveyer 45 while keeping in contact with the outer opening of the metering through-hole 21 of the sheet-like frame 22. Thus, the first sheet 101' of continuous length and the metering through-hole 21 forms a volumetric metering space for a fluidized substance having a prescribed capacity.

A supplying unit 3 for supplying a fluidized substance is set within the orbit of the chain conveyer 23. The supplying unit 3 has a pair of gear pumps in the lower part of a supply pipe 31 for a fluidized substance. The gear pumps operate to extrude a given amount of a fluidized substance 103' stored in the supply pipe 31 toward a leveling unit 32 which is provided below the gear pumps. The leveling unit 32 comprises a cylindrical roller so as to level the upper plane of the sheet-like frame 22.

An ejecting roller 25 is provided downstream the leveling unit 32 in the sheet moving direction. The ejecting roller 25 is used for removing the fluidized substance packed into the volumetric metering space and transferring the fluidized substance onto the first sheet 101' of continuous length. The ejecting roller 25 has a cylindrical shape with a plurality of projections each capable of fitting into the metering through-hole 21. Even in case where the fluidized substance is such a substance as sets into a hard body, it is easy, with this apparatus 1, to remove the body without causing breakage.

Still another embodiment of the present invention will now be described. The embodiment pertains to production of detergent articles of sheet form as packages of the fluidized substance by using a detergent dough composition as one of dough fluids. The description given to the embodiment shown in FIGS. 1 to 3 appropriately applies to those particulars that are not described below with respect to the present embodiment.

The term "dough" as used herein means a mixture comprising a powdered composition kneaded with a substance having fluidity, such as liquid, paste, gel, etc. as described in Japanese Patent Laid-Open No. 10-204499. The substance having fluidity includes those which gain fluidity upon application of heat, pressure or shear.

Figure 6:
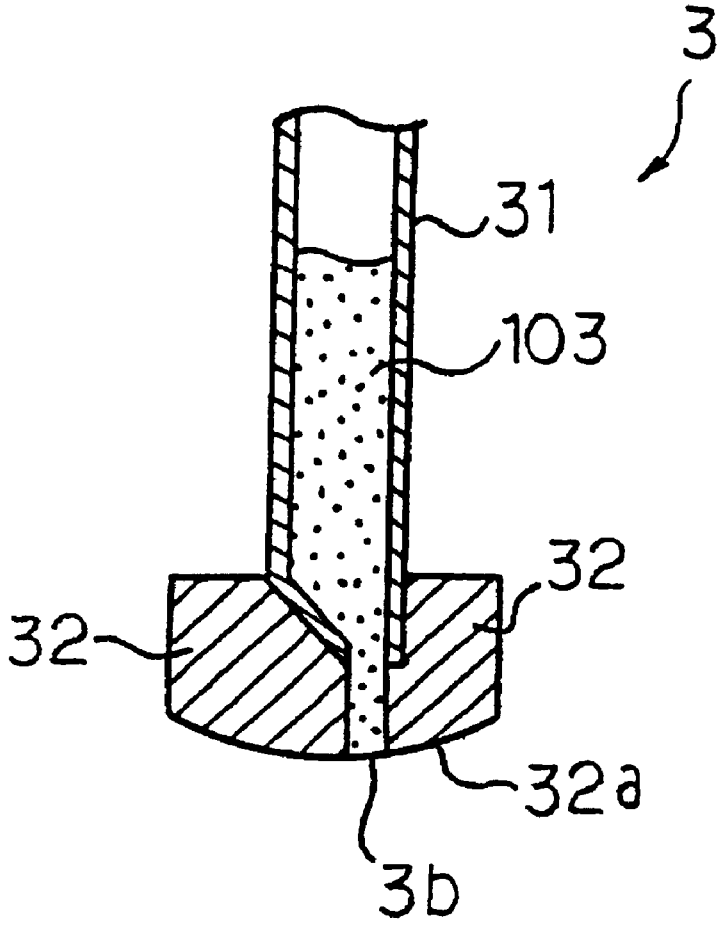
FIG. 6 is an enlarged view of the main part of the supplying unit of another apparatus which can be used in the method for producing a package of a fluidized substance according to the present invention (corresponding to FIG. 2).

Practically the same apparatus as shown in FIGS. 1 through 3 is used in this embodiment, provided that a higher shearing force is needed to fill the volumetric metering space formed by the metering through-hole 21 and the first sheet 101' of continuous length with the detergent dough composition because of the higher viscosity of the dough used as a fluidized substance than that of powder. Hence, as shown in FIG. 6, the opening 3*b* of the supplying unit 3 has a narrower slit width d than shown in FIG. 2. Further, the pressure for supplying the detergent dough composition from a supply source of the fluidized substance (not shown) to the supplying unit 3 is made higher than that for supplying powder. By these manipulations the volumetric metering space can be closely filled with the detergent dough composition under a high shearing force.

Taking into consideration various characteristics required of detergent articles of sheet form, it is preferred that the detergent dough composition supplied from the supplying unit 3 onto the first sheet 101' of continuous length be shaped to have a thickness of 0.5 to 10 mm.

The detergent dough composition used in the present embodiment preferably contains at least one surface active agent, at least one alkali agent, and at least one metal ion scavenger.

The first sheet 101 and the second sheet 102 used in the present embodiment include sheets or webs having flexibility, such as synthetic resin films and fibrous sheets, e.g., woven or non-woven fabric. The flexible sheet is preferably soluble or dispersible in water. Where the flexible sheet is water-soluble, materials making the flexible sheet preferably include those described in Japanese Patent Laid-Open No. 10-204499, col. 12, 11. 16–33. Polyvinyl alcohol is preferred.

On use, a requisite number of the detergent articles of sheet form manufactured according to the present embodiment are put into a washing machine to do the laundry.

The present invention should not be construed as being limited to the aforementioned embodiments. For example, the seamless belt and the suction conveyer used in the foregoing embodiments combine the function as a first sheet conveying means and the function as a means for pressing the first sheet toward the leveling unit. Instead, these functions can be performed by separate members, i.e., a first sheet conveying means and a means for pressing the first sheet to the leveling unit.

The shape and the pitch of all the packages 100 of the fluidized substance in the link of packages 100' shown in FIGS. 1 and 5 do not need to be the same. They can be produced with varied shapes at varied pitches.

Industrial Applicability

According to the method for producing a package of a fluidized substance of the present invention, a package of a fluidized substance can be produced with good productivity, and a package of a fluidized substance in which a variety of fluidized substances are packaged in arbitrary shapes can be manufactured.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a package of a fluidized substance, said method comprising the steps of:

supplying a fluidized substance on a first sheet;

covering the supplied fluidized substance with a second sheet; and sealing the two sheets together in a prescribed shape to make a package of a fluidized substance comprising said first sheet, said second sheet and said fluidized substance held therebetween, wherein said step of supplying the fluidized substance includes the steps of:

supplying a prescribed amount of said fluidized substance onto said first sheet by use of a metering-applicator for said fluidized substance, said metering-applicator comprising a metering through-hole having an outer opening and an inner opening forming a volumetric metering space therebetween, said volumetric metering space having a prescribed volume and shape;

positioning said first sheet so as to be brought into contact with said outer opening of said metering through-hole; and supplying said fluidized substance from said inner opening of said metering through-hole into said volumetric metering hole and then onto said first sheet while said first sheet is conveyed to supply a measured, prescribed amount of said fluidized substance onto said first sheet.

2. The method for producing a package of a fluidized substance according to claim 1, wherein said metering-applicator for the fluidized substance comprises a cylindrical body and a plurality of said metering through-holes piercing said cylindrical body in a radial direction of said cylindrical body, each of said metering through-holes forming a volumetric metering space for supplying the measured, prescribed amount of said fluidized substance onto said first sheet, respectively.

3. The method for producing a package of a fluidized substance according to claim 1, wherein said fluidized substance contains iron powder; and a magnet is disposed under said first sheet on the side opposite to the side where said fluidized substance has been supplied so that the measured, prescribed amount of said fluidized substance may retain its overall shape by the action of the magnet.

4. An apparatus for use in the method for producing a package of a fluidized substance according to claim 1, said apparatus comprising:

a metering-applicator for a fluidized substance said metering applicator comprising a cylindrical body and a plurality of metering through-holes piercing said cylindrical body in a radial direction of said cylindrical body, each of said metering through-holes forming a volumetric metering space for supplying the measured prescribed amount of said fluidized substance to said first sheet, respectively;

a supplying unit for supplying the fluidized substance into each of said metering through-holes, said supplying unit comprising a supply pipe for the fluidized substance and a leveling unit, which joins the lower part of said supply pipe and has an opening for supplying the fluidized substance, said leveling unit being disposed inside said metering-applicator in such a manner that said leveling unit is brought into contact with the inner wall of said metering-applicator; and a means for conveying said first sheet and pressing said first sheet toward said leveling unit.

5. An apparatus for producing a package of a fluidized substance, comprising:

a metering-applicator for the fluidized substance, said metering-applicator comprising a metering through-hole having an outer opening and an inner opening forming a volumetric metering space therebetween, said volumetric metering space having a prescribed volume and shape;

a first conveyor for conveying a first sheet into contact with said outer opening;

a second conveyor for conveying a second sheet, said second sheet for covering the fluidized substance supplied to the first sheet; and a device for sealing the two sheets together in a prescribed shape to make a package of a fluidized substance comprising said first sheet, said second sheet and the fluidized substance held therebetween, wherein said fluidized substance is supplied from said inner opening of said metering through-hole into said volumetric metering hole and then onto said first sheet while said first sheet is conveyed to supply a measured, prescribed amount of said fluidized substance onto said first sheet.

6. The apparatus for producing a package of a fluidized substance according to claim 5, wherein said metering-applicator for the fluidized substance comprises a cylindrical body and a plurality of said metering through-holes piercing said cylindrical body in a radial direction of said cylindrical body, each of said metering through-holes forming a volumetric metering space for supplying the measured, prescribed amount of said fluidized substance onto said first sheet, respectively.

7. The apparatus for producing a package of a fluidized substance according to claim 5, wherein said fluidized substance contains iron powder; and a magnet is disposed under said first sheet on the side opposite to the side where said fluidized substance has been supplied so that the measured, prescribed amount of said fluidized substance may retain its overall shape by the action of the magnet.

8. The apparatus for producing a package of a fluidized substance according to claim 6, wherein said apparatus further comprises a supplying unit for supplying the fluidized substance into each of said metering through-holes, said supplying unit comprising a supply pipe for the fluidized substance and a leveling unit, which joins the lower part of said supply pipe and has an opening for supplying the fluidized substance, said leveling unit being disposed inside said metering-applicator in such a manner that said leveling unit is brought into contact with the inner wall of said metering-applicator.

* * * * *